US011330854B2

(12) United States Patent
Abukashef

(10) Patent No.: US 11,330,854 B2
(45) Date of Patent: May 17, 2022

(54) T-SHIRT APPAREL WITH INTEGRATED DEEP POCKETS

(71) Applicant: Abdalla Abukashef, Houston, TX (US)

(72) Inventor: Abdalla Abukashef, Houston, TX (US)

( * ) Notice: Subject to any disclaimer, the term of this patent is extended or adjusted under 35 U.S.C. 154(b) by 240 days.

(21) Appl. No.: 16/724,461

(22) Filed: Dec. 23, 2019

(65) Prior Publication Data

US 2020/0196691 A1 Jun. 25, 2020

Related U.S. Application Data

(60) Provisional application No. 62/783,873, filed on Dec. 21, 2018.

(51) Int. Cl.

| | |
|---|---|
| ***A41D 27/20*** | (2006.01) |
| ***A41B 1/08*** | (2006.01) |
| *A41D 27/00* | (2006.01) |

(52) U.S. Cl.

CPC ..... *A41D 27/201* (2013.01); *A41B 1/08* (2013.01); *A41D 27/208* (2013.01)

(58) Field of Classification Search

CPC ..... A41D 27/201; A41D 27/208; A41D 1/04; A41D 27/202; A41B 1/08

See application file for complete search history.

(56) References Cited

U.S. PATENT DOCUMENTS 352,297 A * 11/1886 Cohlman ..... A41D 1/06 2/227
1,088,891 A * 3/1914 Filson ..... A41D 1/04 2/115
2,263,538 A * 11/1941 Freirich ..... A41D 13/04 2/51
2,508,190 A * 5/1950 Previdi ..... A45F 5/00 2/253
2,607,040 A * 8/1952 Zaleski ..... A41D 13/04 2/51
2,617,103 A * 11/1952 Westgarth ..... A41D 13/04 2/48
2,697,465 A * 12/1954 Johnson ..... A45C 15/00 383/4
2,840,824 A * 7/1958 Horner ..... A41D 27/20 2/247

(Continued)

OTHER PUBLICATIONS

Clothes, (n.d.) American Heritage® Dictionary of the English Language, Fifth Edition. (2011). Retrieved Oct. 18, 2021 from https://www.thefreedictionary.com/clothes (Year: 2011).*

(Continued)

*Primary Examiner* — Robert H Muromoto, Jr.

(57) ABSTRACT

A t-shirt apparel with integrated deep pockets includes a t-shirt body, at least one upper pocket, and a lower pocket. The t-shirt body includes a front panel and a rear panel as the front panel and the rear panel are perimetrically connected to each other. The at least one upper pocket includes an upper pocket body and an upper opening. The lower pocket includes a lower pocket body and a lower opening. The upper pocket body is internally integrated to a chest section of the front panel. The upper opening traverses into the upper pocket body through the chest section. The lower pocket body is internally integrated to a waist section of the front panel. The lower opening traverses into the lower pocket body through the waist section.

3 Claims, 9 Drawing Sheets

(56) References Cited

U.S. PATENT DOCUMENTS 2,846,685 A * 8/1958 Ehrich ..... A41D 13/0012 2/51
2,997,719 A * 8/1961 Levi ..... A41D 27/20 2/253
4,062,064 A * 12/1977 Vosatka ..... A41D 27/202 2/252
D257,596 S * 12/1980 Rosenbloom, III ..... D2/864
4,535,878 A * 8/1985 Grahl ..... A45C 3/10 190/1
4,637,075 A * 1/1987 Ingrisano ..... A41D 13/0012 2/102
4,651,348 A * 3/1987 Swanson ..... A41D 27/20 2/253
4,791,681 A * 12/1988 Dean ..... A41D 13/012 2/102
4,860,388 A * 8/1989 Dean ..... A41D 13/012 2/247
5,075,900 A * 12/1991 Chittenden ..... A41D 13/0012 2/94
5,082,157 A * 1/1992 Emerson-Santos ..... A45C 1/04 224/587
5,195,187 A * 3/1993 Yang ..... A41D 13/0012 2/102
5,509,147 A * 4/1996 Busquets ..... A41D 27/202 112/441
5,517,696 A * 5/1996 Krugler ..... A41D 27/20 2/250
5,652,961 A * 8/1997 Knight-Yurt ..... A41D 13/0012 2/106
5,724,679 A * 3/1998 Hans ..... A41D 27/20 2/238
5,987,644 A * 11/1999 Mengato ..... A41D 27/202 2/69
6,049,914 A * 4/2000 Heilman ..... A41D 13/0012 2/247
6,363,538 B1 * 4/2002 Davis ..... A41D 1/08 2/247
6,421,834 B2 * 7/2002 Kester ..... A41D 15/04 2/94
D461,945 S * 8/2002 Byrd ..... D2/860
6,826,782 B2 * 12/2004 Jordan ..... A41D 1/005 2/94
6,910,224 B2 * 6/2005 Ikenaga ..... A41D 13/0125 2/102
6,993,940 B2 * 2/2006 Rabinowicz ..... A41D 13/0015 66/176
7,058,987 B2 * 6/2006 Salazar ..... A41D 1/06 2/227
7,219,373 B2 * 5/2007 McNamara ..... A41D 13/0012 2/247
7,364,491 B2 * 4/2008 Updyke ..... A41C 3/0035 2/247
7,631,368 B1 * 12/2009 Samson ..... F41C 33/02 2/115
D623,830 S * 9/2010 Marois ..... D2/857
7,886,368 B2 * 2/2011 Hood ..... A41D 27/20 2/102
8,032,948 B2 * 10/2011 Anderson ..... A41D 3/00 2/69
8,312,568 B2 * 11/2012 Marois ..... A41D 27/20 2/252
8,566,963 B2 * 10/2013 Ryan ..... A41D 27/201 2/84
8,756,716 B2 * 6/2014 Jordan ..... A41D 1/005 2/247
9,060,550 B2 * 6/2015 Conrad ..... A41C 3/0057
9,192,199 B1 * 11/2015 Lodza ..... A41D 13/0012
9,271,533 B2 * 3/2016 Kochling ..... A41D 27/205
9,370,211 B2 * 6/2016 Yee ..... A41D 13/0012
9,456,639 B2 * 10/2016 Aylward ..... A41D 13/0012
9,648,918 B2 * 5/2017 Grady ..... A45F 5/022
9,775,392 B2 * 10/2017 Peterson ..... A41D 27/201
9,844,235 B2 * 12/2017 Asnis ..... A41D 1/002
D816,301 S * 5/2018 Notarianni ..... D2/840
10,010,117 B1 * 7/2018 Rendone ..... A41C 3/0014
10,238,152 B2 * 3/2019 Rendone ..... A41C 3/0014
D851,858 S * 6/2019 Hunter ..... D2/706
10,314,344 B2 * 6/2019 Wittstadt ..... A41C 3/0035
10,674,773 B2 * 6/2020 McGaughy ..... A41C 3/12
10,674,777 B2 * 6/2020 Fisher ..... A41F 9/025
10,791,774 B2 * 10/2020 Plant ..... A41D 27/207
11,026,457 B1 * 6/2021 Mayer ..... A41D 27/20
11,140,931 B1 * 10/2021 Stewart ..... A41D 3/005
2002/0157170 A1 * 10/2002 Lipscher ..... A41D 27/20 2/250
2005/0101203 A1 * 5/2005 Kemp ..... A41D 13/0125 441/106
2005/0177922 A1 * 8/2005 Ikenaga ..... A41D 13/0125 2/102
2005/0235398 A1 * 10/2005 Yoo ..... A41D 27/208 2/247
2008/0032600 A1 * 2/2008 Updyke ..... A41C 3/0057 450/89
2008/0047046 A1 * 2/2008 Maier ..... A41D 13/0007 2/102
2008/0250996 A1 * 10/2008 Ji ..... A41D 27/204 112/475.09
2009/0104845 A1 * 4/2009 Pintor ..... A41C 3/0035 450/31
2009/0300818 A1 * 12/2009 Waite ..... A41F 9/00 2/76
2010/0071110 A1 * 3/2010 Stevens ..... A45F 3/14 2/69
2012/0031980 A1 * 2/2012 Tiedmann ..... G08B 13/2434 235/492
2013/0061367 A1 * 3/2013 Garneau ..... A41D 13/0012 2/85
2013/0248310 A1 * 9/2013 Taylor-Phillips ..... A45C 13/03 190/111
2013/0325648 A1 * 12/2013 Kanner ..... G06Q 30/0621 705/26.5
2014/0182044 A1 * 7/2014 Cole ..... A41D 27/208 2/69
2015/0082506 A1 * 3/2015 Yee ..... A41D 27/204 2/69
2015/0257459 A1 * 9/2015 Cockram ..... A41D 31/18 2/212
2015/0289570 A1 * 10/2015 Conrad ..... A41C 3/0057 450/30
2015/0296909 A1 * 10/2015 Sachs ..... A41B 1/08 2/84
2016/0242474 A1 * 8/2016 Baschak ..... A41D 31/102
2017/0020215 A1 * 1/2017 Merritt ..... A41D 1/04
2017/0105466 A1 * 4/2017 Baschak ..... A41D 27/28
2017/0164670 A1 * 6/2017 Hale ..... A41D 27/24
2017/0172239 A1 * 6/2017 Staub ..... A41D 27/24
2017/0245567 A1 * 8/2017 Fathollahi ..... H02J 7/0027
2018/0064236 A1 * 3/2018 Wolfe ..... A41D 27/20
2018/0103703 A1 * 4/2018 Rinne ..... A41D 13/0012
2018/0160751 A1 * 6/2018 Epp Frenette ..... A45F 5/02
2018/0228232 A1 * 8/2018 Fisher ..... A41F 9/025
2018/0343941 A1 * 12/2018 Arnold ..... A41D 3/04
2019/0059466 A1 * 2/2019 Broughton ..... A41B 9/06
2019/0075917 A1 * 3/2019 Preston ..... A41D 27/20
2019/0200739 A1 * 7/2019 Green Mullins ..... A41D 27/20
2020/0013314 A1 * 1/2020 Hare ..... G09B 23/30
2020/0029637 A1 * 1/2020 Boyd ..... A41D 27/205
2020/0146377 A1 * 5/2020 McCarty ..... A41D 27/20
2020/0221801 A1 * 7/2020 Rinne ..... A45F 5/022
2021/0267291 A1 * 9/2021 Mayer ..... A41D 27/201

OTHER PUBLICATIONS

T-shirt, (n.d.) Collins English Dictionary—Complete and Unabridged, 12th Edition 2014. (1991, 1994, 1998, 2000, 2003, 2006,

(56) References Cited

OTHER PUBLICATIONS 2007, 2009, 2011, 2014). Retrieved Oct. 18, 2021 from https://www.thefreedictionary.com/T-shirt (Year: 2014).*

* cited by examiner

T-SHIRT APPAREL WITH INTEGRATED DEEP POCKETS

The current application claims a priority to the U.S. Provisional Patent application Ser. No. 62/783,873 filed on Dec. 21, 2018.

FIELD OF THE INVENTION

The present invention relates generally to an apparel. More specifically, the present invention is a t-shirt with integrated deep pockets for easy access storage of useful, everyday items.

BACKGROUND OF THE INVENTION

T-shirts have been flourishing as a form of personal expression and comfortable upper garment throughout the history. Traditionally t-shirts have short sleeve and a round neckline, known as a crew neck and lacks a collar. T-shirts are generally made of a stretchy, light and inexpensive fabric and are easy to clean. T-shirts normally comes in short sleeve configuration, long sleeve configuration, and sleeve less configuration to accommodate variety of consumer needs and requirements. Normally, t-shirts does not have a pocket and that leads into lack of storage for the users. For example, people carry many gadgets and items such as smartphones, wallets, protection items, keys, and other basic items. The current design of t-shirts do not provide storage space to carrying of these items safely and have too many limitations.

It is there an objective of the present invention to provide a t-shirt with integrated deep pockets so that the user is able to store daily items. The present invention would be worn the same way as an individual would wear a regular t-shirt while the integrated deep pockets are positioned adjacent to the chest area and the waist area. The integrated deep pockets can also be closed and opened through a fastening mechanism that is generally hidden behind a cover. Resultantly, the present invention is able to provide a functional and aesthetically pleasing t-shirt.

DETAIL DESCRIPTIONS OF THE INVENTION

All illustrations of the drawings are for the purpose of describing selected versions of the present invention and are not intended to limit the scope of the present invention.

The present invention is a t-shirt apparel with integrated deep pockets so that the user can be presented with additional storage space. The present invention would be worn the same way as an individual would wear a regular t-shirt; however, the integrated deep pockets help the user to safely carry any additional items such as mobile phones, electronic tables, keys, headphones, wallets, or any other daily usable items. Even though the illustrated figures of the preferred embodiment of present invention shows a short sleeve t-shirt, the present invention can be utilized within a long sleeve t-shirt or a sleeve less t-shirt.

Figure 1:
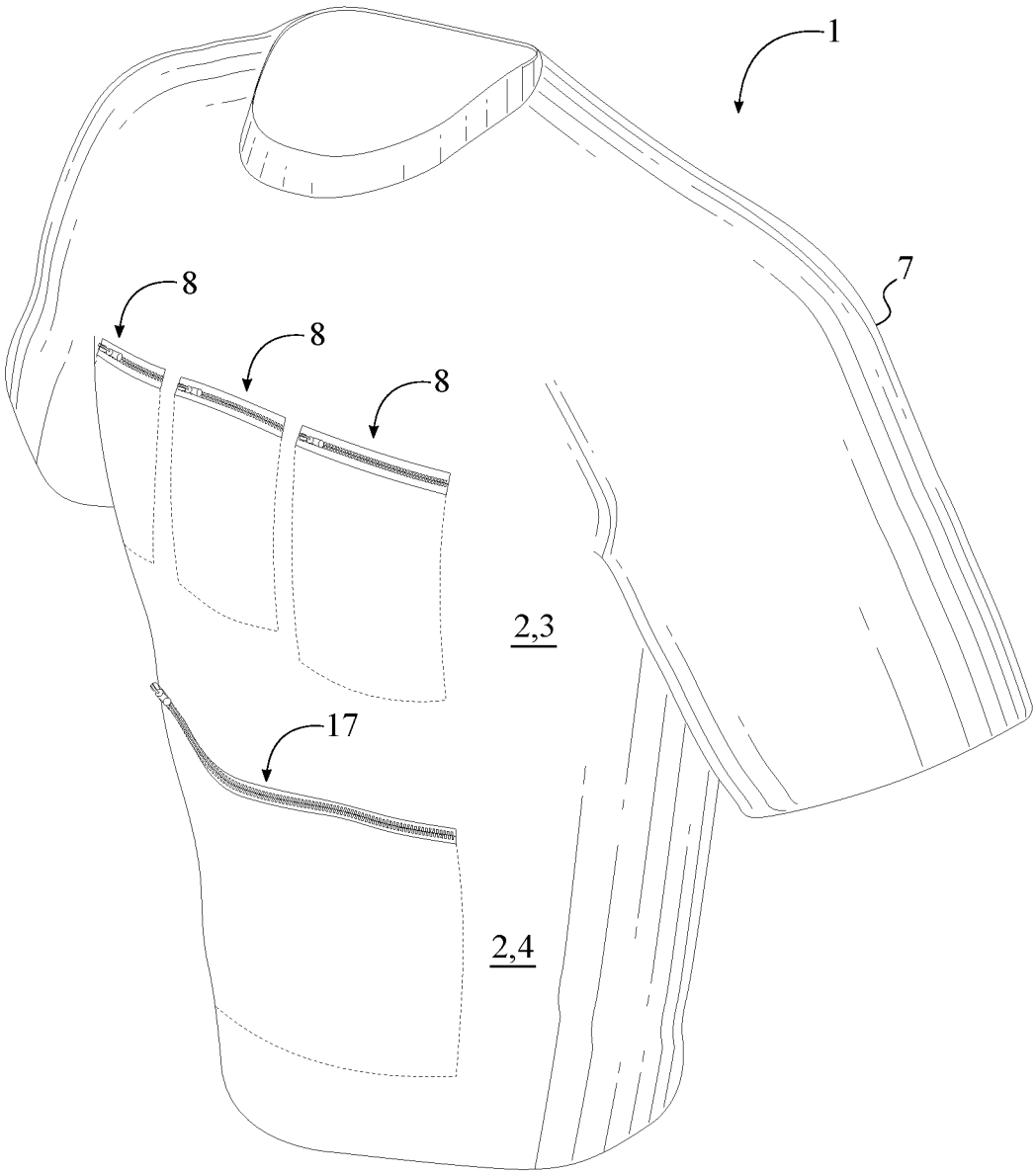
FIG. 1 is a perspective view of the present invention without showing the left, right, middle, and lower covers, wherein the dash lines illustrate the internal positioning of the least one upper pocket and the lower pocket.
Figure 2:
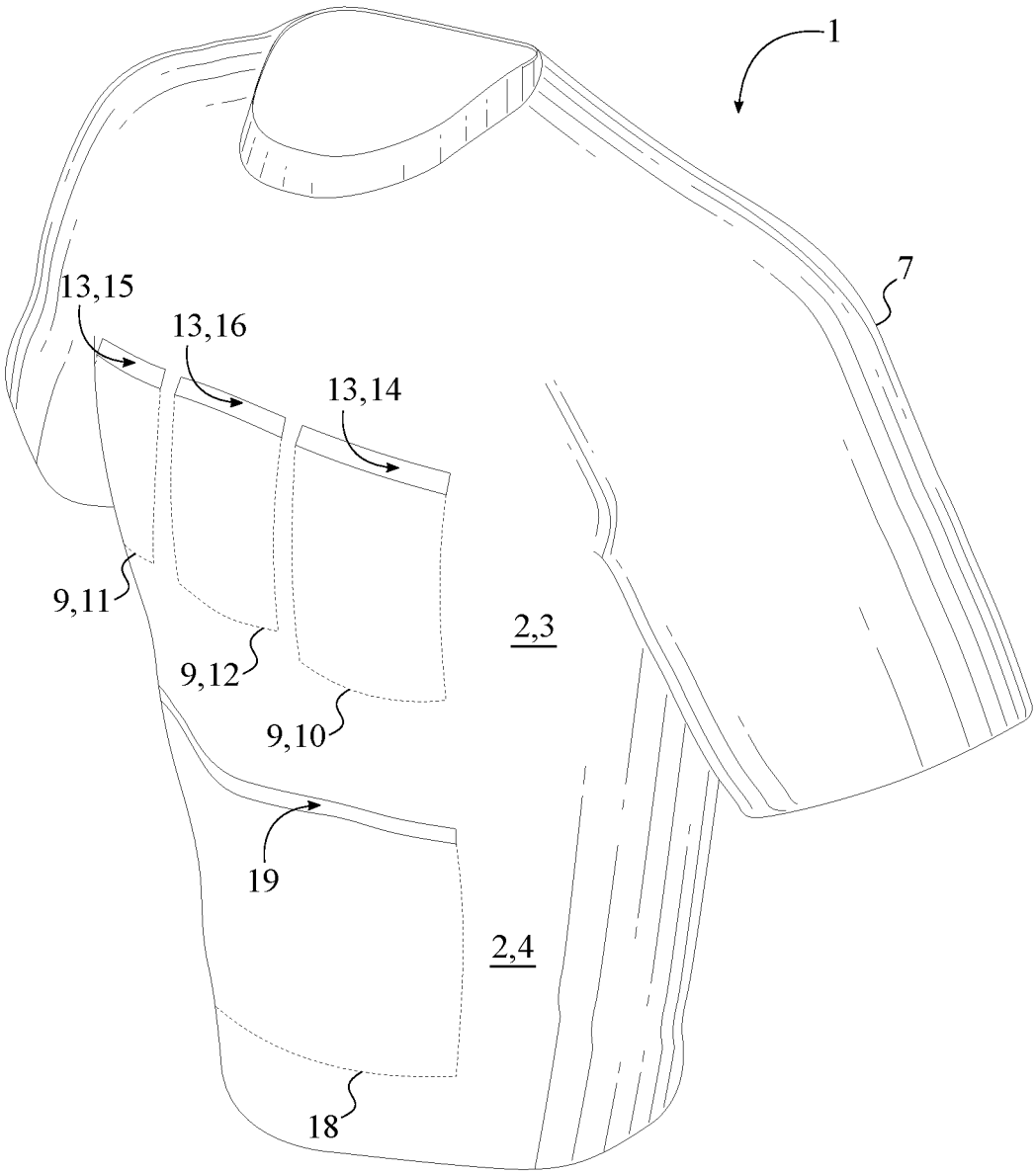
FIG. 2 is a perspective view of the present invention showing the left, right, middle, and lower openings.

The present invention comprises a t-shirt body 1, at least one upper pocket 8, and a lower pocket 17 as shown in FIG. 1. The t-shirt body 1 comprises a front panel 2 and a rear panel 7, wherein the front panel 2 and the rear panel 7 are perimetrically connected to each other. As a result, the front panel 2 and the rear panel 7 are able to delineate the general shape of the t-shirt body 1 that covers the user's torso. The at least one upper pocket 8 comprises an upper pocket body 9 and an upper opening 13, and the lower pocket 17 comprises a lower pocket body 18 and a lower opening 19 as shown in FIG. 1-2. In reference to the general configuration of the present invention, the upper pocket body 9 is internally integrated to a chest section 3 of the front panel 2 so that the upper pocket body 9 can be hidden within the t-shirt body 1. The upper opening 13 traverses into the upper pocket body 9 through the chest section 3 thus providing a breach within the t-shirt body 1 to access the inside of the upper pocket body 9. The lower pocket body 18 is internally integrated to a waist section 4 of the front panel 2 so that the lower pocket body 18 can be hidden within the t-shirt body 1. The lower opening 19 traverses into the upper pocket body 9 through the waist section 4 thus providing a breach within the t-shirt body 1 to access the inside of the lower pocket body 18.

Figure 3:
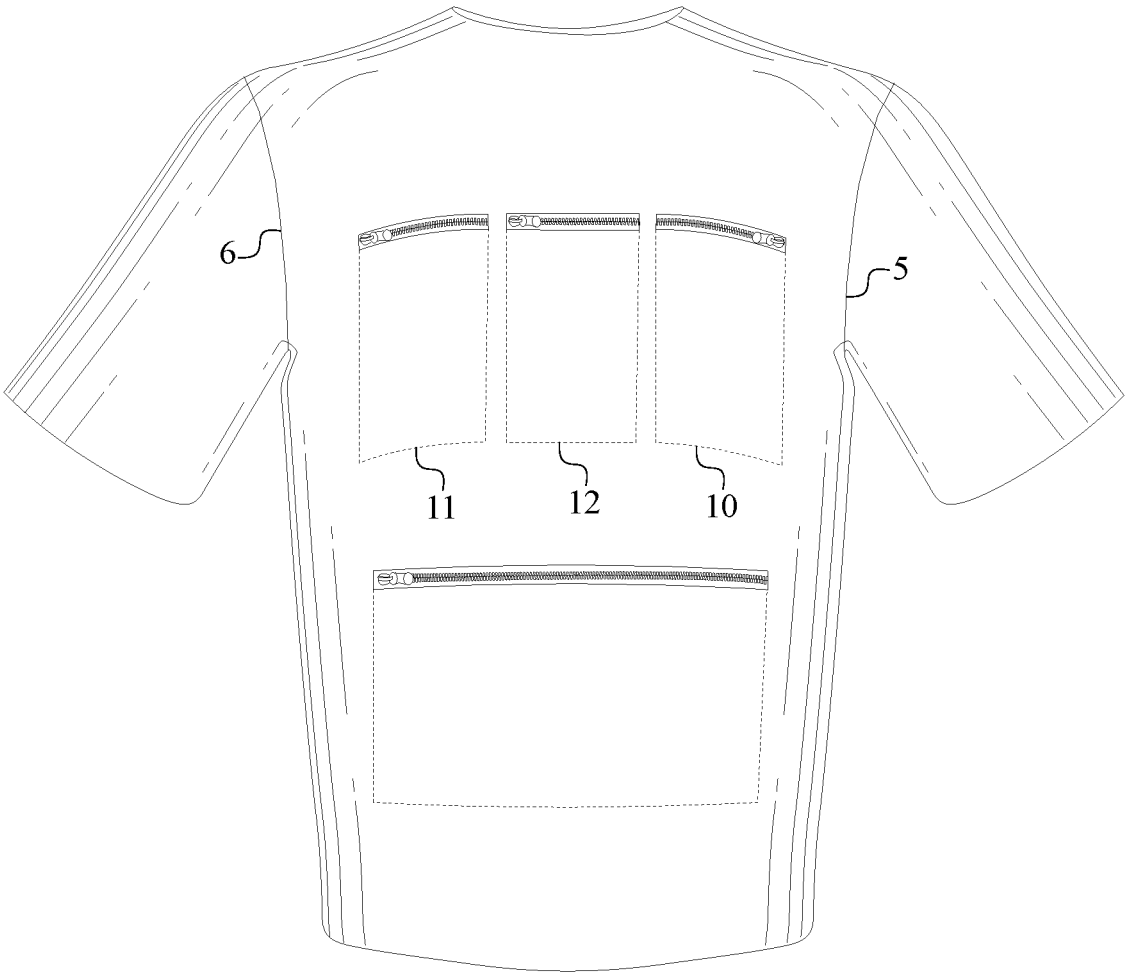
FIG. 3 is a front view of the present invention showing the distribution of the pockets.

In reference to FIG. 2-3, the upper pocket body 9 comprises a left pocket body 10, a right pocket body 11, and a middle pocket body 12. The upper opening 13 comprises a left opening 14, a right opening 15, and a middle opening 16. The left pocket body 10, the right pocket body 11, and the middle pocket body 12 are linearly distributed across the chest section 3 thus providing a fashionable external appearance for the t-shirt body 1. The linear arrangement of the left pocket body 10, the right pocket body 11, and the middle pocket body 12 enables the user to easily access the respective pocket body with their left hand or right hand. More specifically, the left pocket body 10, the right pocket body 11, the middle pocket body 12 provide upper storage areas and are perimetrically connected to the chest section 3 from the inside surface of the front panel 2. The left opening 14 traversing into the left pocket body 10 through the chest section 3 so that the user can put their hand into the left pocket body 10 through the left opening 14. Similarly, the right opening 15 traverses into the right pocket body 11 through the chest section 3 so that the user can put their hand into the right pocket body 11 through the right opening 15. Similarly, the middle opening 16 traverses into the middle pocket body 12 through the chest section 3 so that the user can put their hand into the middle pocket body 12 through the middle opening 16.

Furthermore, the left pocket body 10 is adjacently positioned to a left arm hole stitching 5 of the t-shirt body 1 as shown in FIG. 3. Due to the adjacent positioning of the left pocket body 10 and the left arm hole stitching 5, the user preferably uses their right hand to access the inside of the left pocket body 10. The right pocket body 11 is adjacently positioned to a right arm hole stitching 6 of the t-shirt body 1 as shown in FIG. 3. Due to the adjacent positioning of the right pocket body 11 and the right arm hole stitching 6, the user preferably uses their left hand to access the inside of the right pocket body 11. The middle pocket body 12 is adjacently positioned in between the left pocket body 10 and the right pocket body 11 as shown in FIG. 3. Due to the intermediate positioning of the middle pocket body 12, the user can use their left or right hand to access the inside of the middle pocket body 12.

In reference to FIG. 4-5, FIG. 6, and FIG. 9, the present invention further comprises a left fastener 20 that enable the user to open or close the left pocket body 10 with respect to the chest section 3. The present invention preferably utilize a zipper as the left fastener 20. However, the left fastener 20 is not limited the zipper and can use any other type of easily detachable fasteners such as button fasteners, male and female fasteners, and hook and loop fasteners. The left fastener 20 is adjacently connected to the chest section 3, about the left opening 14 so that the left opening 14 can be selectively enclosed by the left fastener 20. For example, when the left fastener 20 is at an opened position, the user can access the left pocket body 10 through the left opening 14. When the left fastener 20 is at a closed position, access to the left pocket body 10 is prevented as the left opening 14 is enclosed by the left fastener 20.

Figure 5:
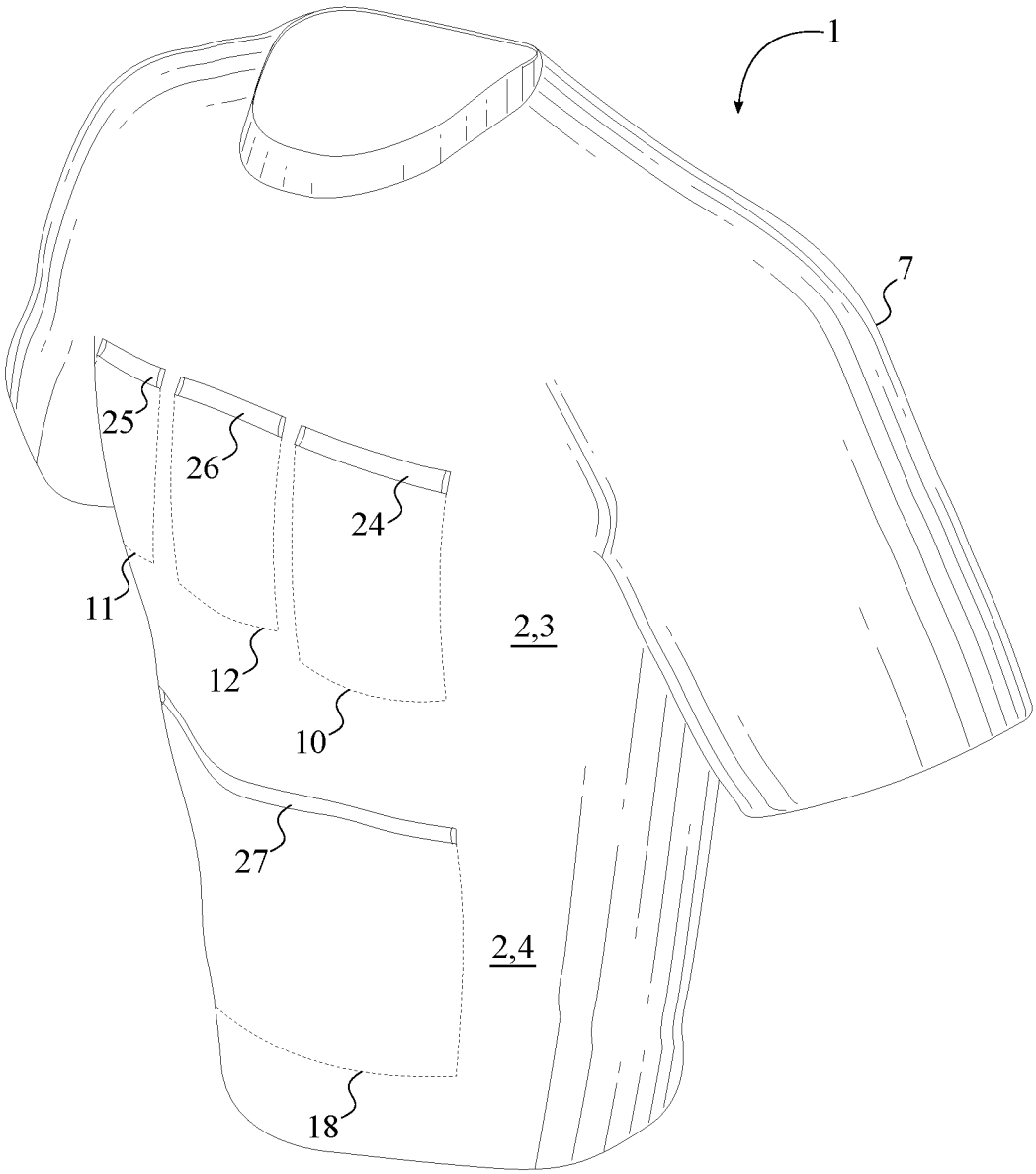
FIG. 5 is a perspective view of the present invention showing the left, right, middle, and lower covers.
Figure 9:
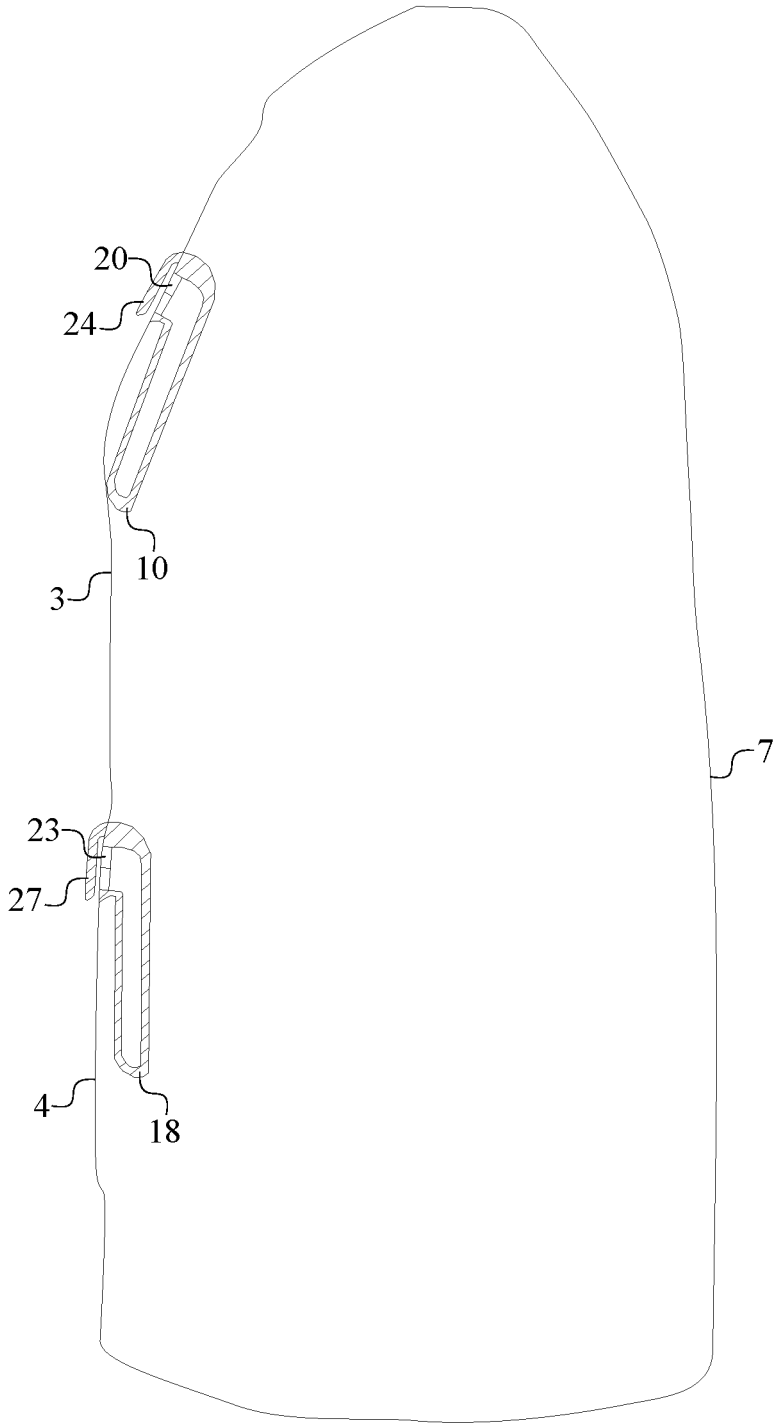
FIG. 9 is a cross sectional view of the present invention along the plane 9-9 of FIG. 6, showing the left pocket body and the lower pocket body.

In reference to FIG. 5 and FIG. 9, the present invention further comprises a left cover 24. The left cover 24 is terminally connected to the chest section 3 so that the left fastener 20 can be enclosed by the left cover 24. In other words, the left cover 24 is able to hide the appearance of left fastener 20 as the left cover 24 is positioned over the left fastener 20. As a result, the present invention is able to provide a hidden fastener appearance to the t-shirt body 1, with respect to the left fastener 20.

In reference to FIG. 4-5, FIG. 6, and FIG. 7, the present invention further comprises a right fastener 21 that enable the user to open or close the right pocket body 11 with respect to the chest section 3. The present invention preferably utilize a zipper as the right fastener 21. However, the right fastener 21 is not limited the zipper and can use any other type of easily detachable fasteners such as button fasteners, male and female fasteners, and hook and loop fasteners. The right fastener 21 is adjacently connected to the chest section 3, about the right opening 15 so that the right opening 15 can be selectively enclosed by the right fastener 21. For example, when the right fastener 21 is at an opened position, the user can access the right pocket body 11 through the right opening 15. When the right fastener 21 is at a closed position, access to the right pocket body 11 is prevented as the right opening 15 is enclosed by the right fastener 21.

Figure 7:
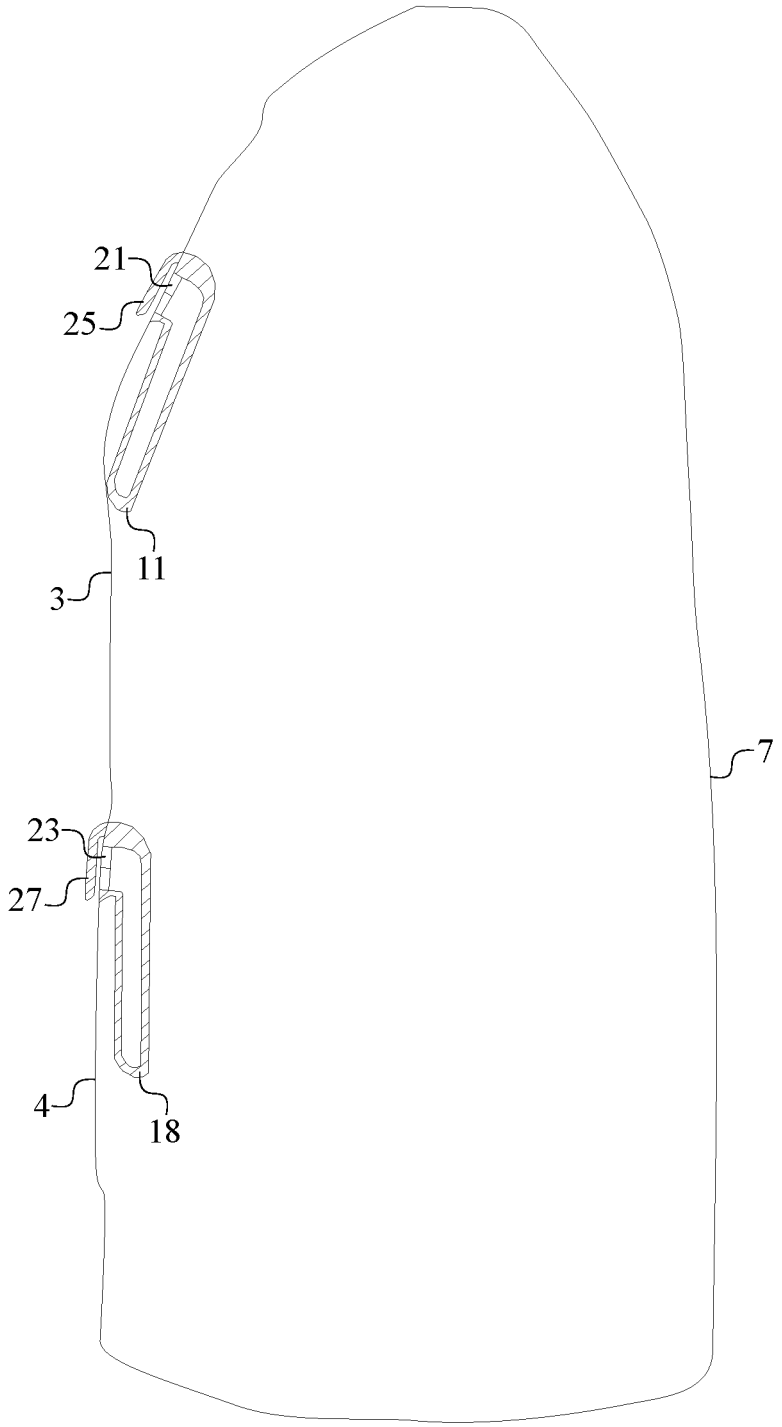
FIG. 7 is a cross sectional view of the present invention along the plane 7-7 of FIG. 6, showing the right pocket body and the lower pocket body.

In reference to FIG. 5 and FIG. 7, the present invention further comprises a right cover 25. The right cover 25 is terminally connected to the chest section 3 so that the right fastener 21 can be enclosed by the right cover 25. In other words, the right cover 25 is able to hide the appearance of right fastener 21 as the right cover 25 is positioned over the right fastener 21. As a result, the present invention is able to provide a hidden fastener appearance to the t-shirt body 1, with respect to the right fastener 21.

In reference to FIG. 4-5, FIG. 6, and FIG. 8, the present invention further comprises a middle fastener 22 that enable the user to open or close the middle pocket body 12 with respect to the chest section 3. The present invention preferably utilize a zipper as the middle fastener 22. However, the middle fastener 22 is not limited the zipper and can use any other type of easily detachable fasteners such as button fasteners, male and female fasteners, and hook and loop fasteners. The middle fastener 22 is adjacently connected to the chest section 3, about the middle opening 16 so that the middle opening 16 can be selectively enclosed by the middle fastener 22. For example, when the middle fastener 22 is at an opened position, the user can access the middle pocket body 12 through the middle opening 16. When the middle fastener 22 is at a closed position, access to the middle pocket body 12 is prevented as the middle opening 16 is enclosed by the middle fastener 22.

Figure 8:
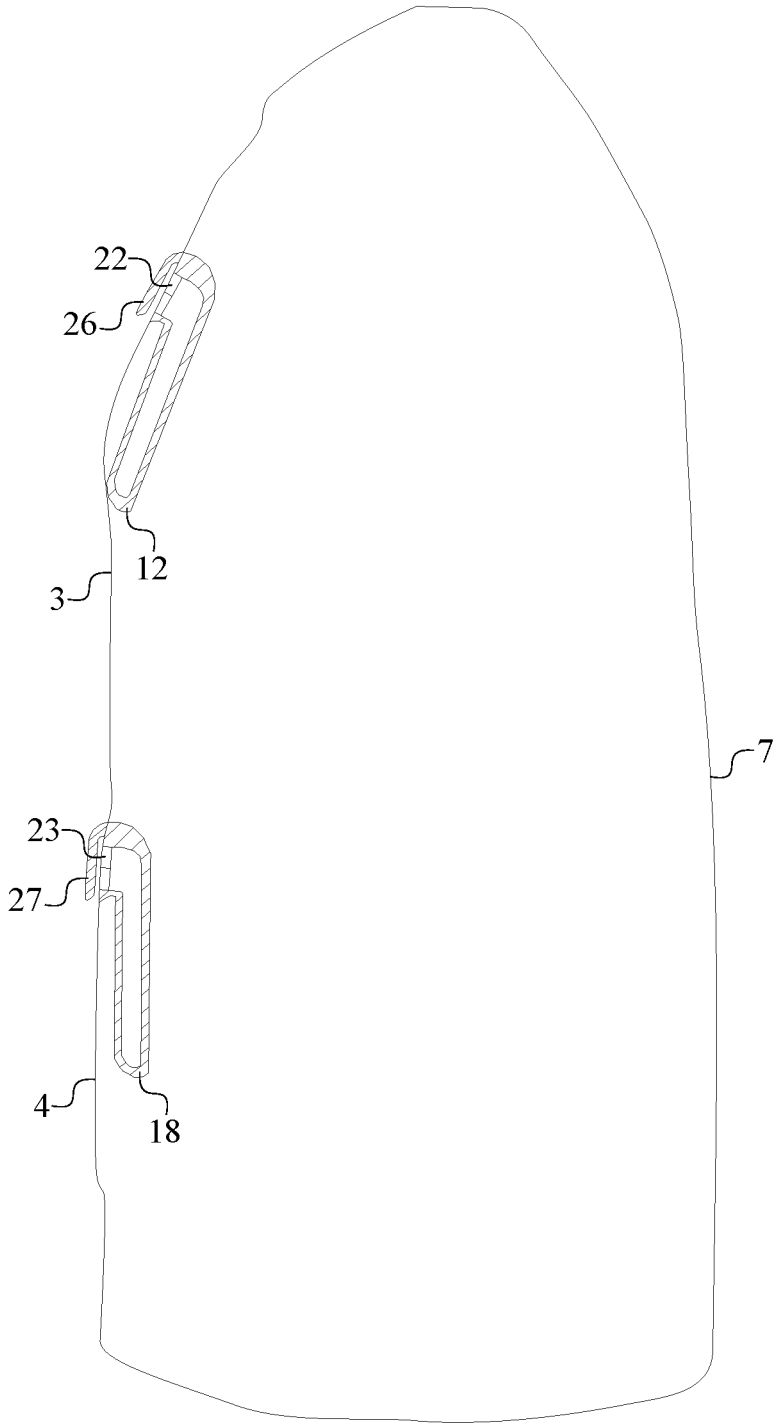
FIG. 8 is a cross sectional view of the present invention along the plane 8-8 of FIG. 6, showing the middle pocket body and the lower pocket body.

In reference to FIG. 5 and FIG. 8, the present invention further comprises a middle cover 26. The middle cover 26 is terminally connected to the chest section 3 so that the middle fastener 22 can be enclosed by the middle cover 26. In other words, the middle cover 26 is able to hide the appearance of middle fastener 22 as the middle cover 26 is positioned over the middle fastener 22. As a result, the present invention is able to provide a hidden fastener appearance to the t-shirt body 1, with respect to the middle fastener 22.

In some embodiment of the present invention, a depth of the upper pocket body 9 ranges from 4 inches to 12 inches and a width of the upper pocket body 9 ranges from 2 inches to 6 inches. A depth of the lower pocket body 18 ranges from 4 inches to 12 inches and a width of the lower pocket body 18 ranges from 8 inches to 14 inches. In the preferred embodiment of the present invention, the depth of the upper pocket body 9 is preferably 7.5 inches and the width of the upper pocket body 9 is preferably 4 inches. The depth of the lower pocket body 18 is preferably 7.5 inches and the width of the lower pocket body 18 is preferably 11 inches.

Figure 4:
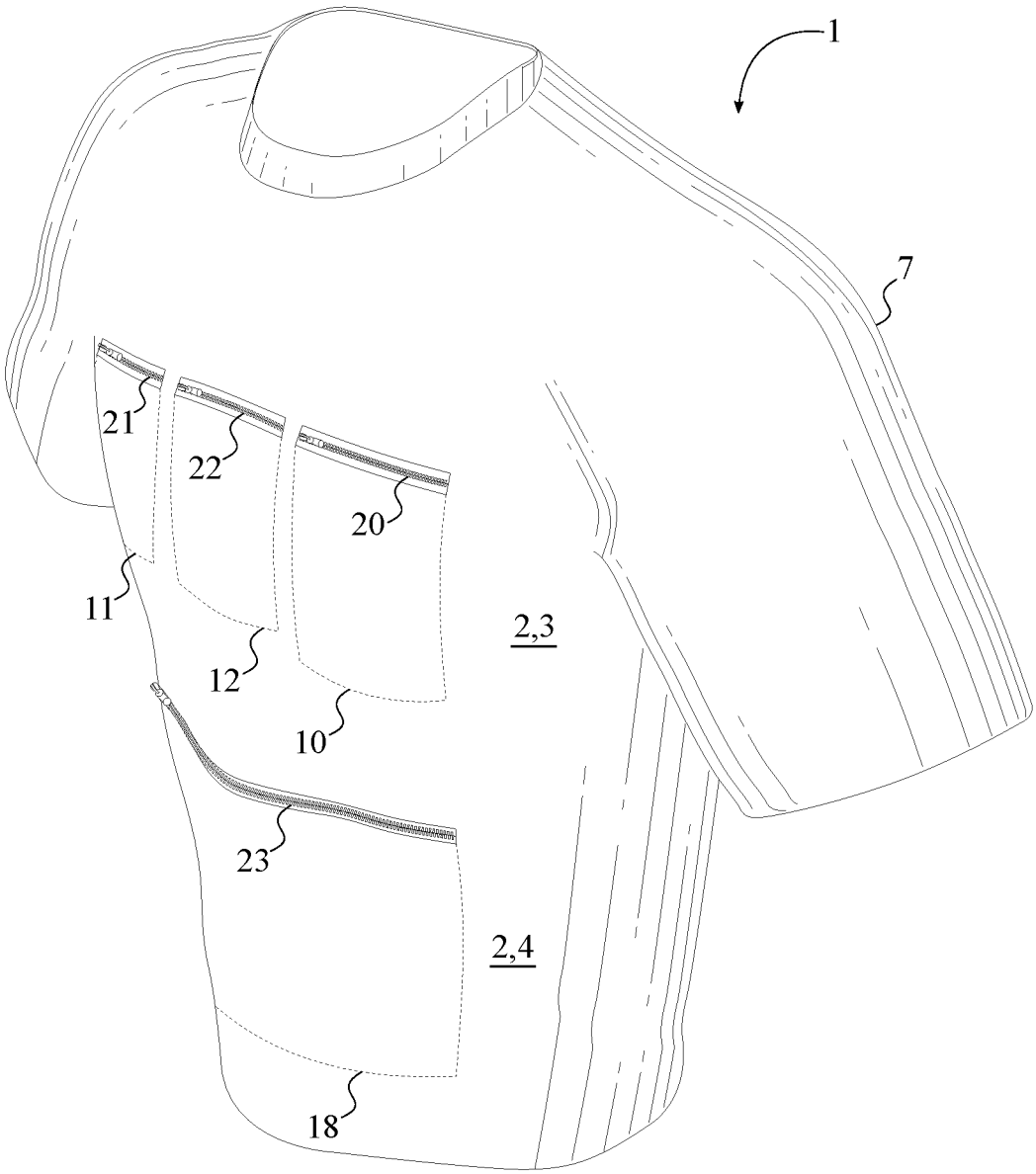
FIG. 4 is a perspective view of the present invention showing the left, right, middle, and lower fasteners.
Figure 6:
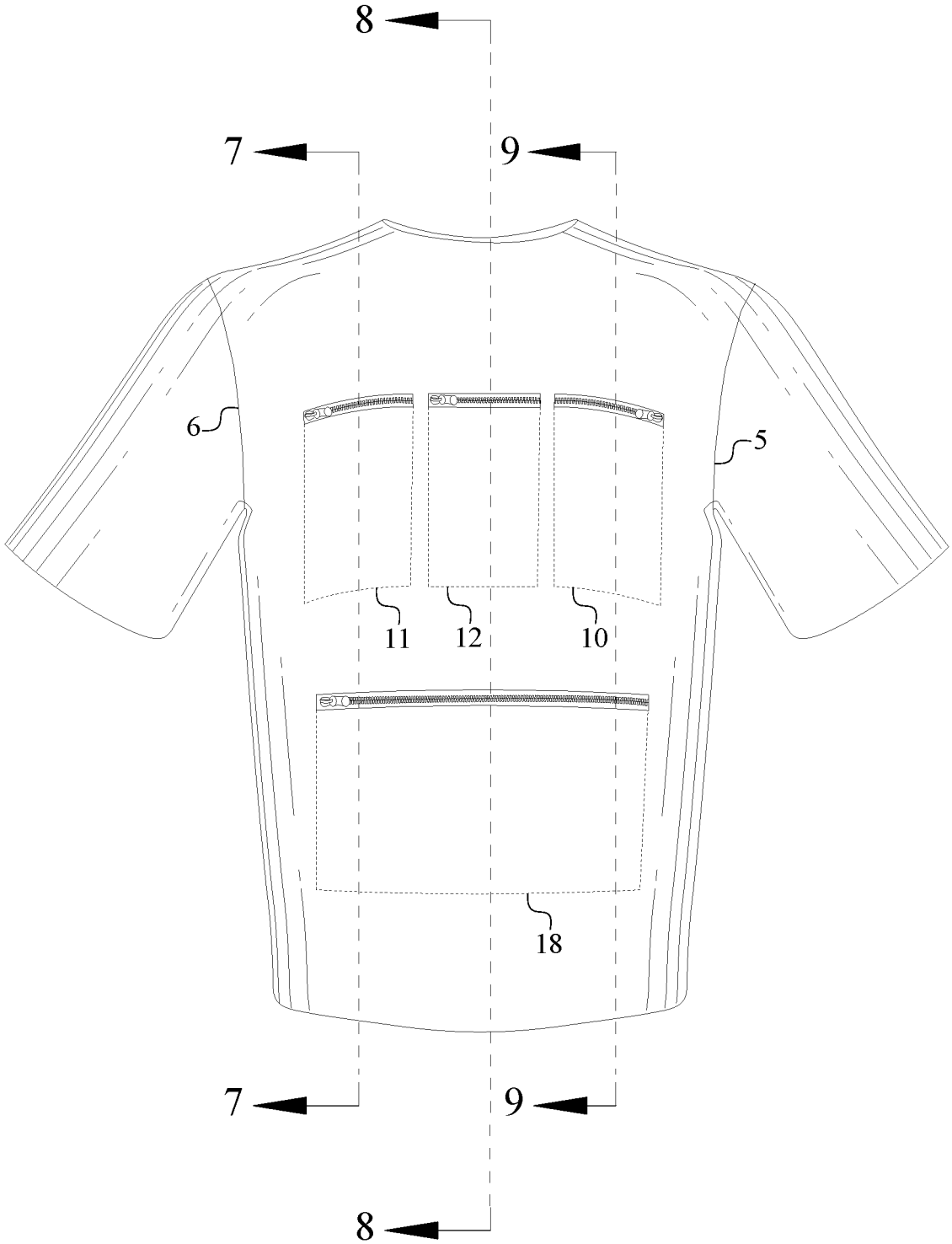
FIG. 6 is a front view of the present invention showing the cross sectional planes.

In reference to FIG. 4 and FIG. 6, the present invention further comprises a lower fastener 23 that enable the user to open or close the lower pocket body 18 with respect to the waist section 4. The lower fastener 23 is positioned parallel to the left fastener 20, the right fastener 21, and the middle fastener 22 as the lower fastener 23 horizontally extended across the waist section 4. The present invention preferably utilize a zipper as the lower fastener 23. However, the lower fastener 23 is not limited the zipper and can use any other type of easily detachable fasteners such as button fasteners, male and female fasteners, and hook and loop fasteners. The lower fastener 23 is adjacently connected to the waist section 4, about the lower opening 19 so that the lower opening 19 can be selectively enclosed by the lower fastener 23. For example, when the lower fastener 23 is at an opened position, the user can access the lower pocket body 18 through the lower opening 19. When the lower fastener 23 is at a closed position, access to the lower pocket body 18 is prevented as the lower opening 19 is enclosed by the lower fastener 23.

In reference to FIG. 7-9, the present invention further comprises a lower cover 27. The lower cover 27 is terminally connected to the waist section 4 so that the lower fastener 23 can be enclosed by the lower cover 27. In other words, the lower cover 27 is able to hide the appearance of lower fastener 23 as the lower cover 27 is positioned over the lower fastener 23. As a result, the present invention is able to provide a hidden fastener appearance to the t-shirt body 1, with respect to the lower fastener 23.

The upper pocket body 9 and the lower pocket body 18 are preferably made from any types of waterproof materials (ex: PVC material) so that the stored content within the respective pockets can be protected from any type of liquid matter.

Although the invention has been explained in relation to its preferred embodiment, it is to be understood that many other possible modifications and variations can be made without departing from the spirit and scope of the invention as hereinafter claimed.

What is claimed is:

1. A t-shirt apparel with integrated deep pockets comprising:

a t-shirt body;

at least one upper pocket;

a lower pocket;

a plurality of fasteners, comprising a left fastener, a right fastener, a middle fastener, and a lower fastener;

a plurality of covers, comprising a left cover, a right cover, a middle cover, and a lower cover;

the t-shirt body comprising a front panel and a rear panel;

the at least one upper pocket comprising an upper pocket body and an upper opening;

the lower pocket comprising a lower pocket body and a lower opening;

the front panel and the rear panel being perimetrically connected to each other;

the upper pocket body comprising a left pocket body, a right pocket body, and a middle pocket body;

the upper pocket body being internally integrated to a chest section of the front panel;

the left pocket body, the right pocket body, and the middle pocket body being linearly distributed across the chest section;

the left pocket body, the right pocket body, the middle pocket body being perimetrically connected to the chest section;

the left pocket body being adjacently positioned to a left arm hole stitching of the t-shirt body;

the right pocket body being adjacently positioned to a right arm hole stitching of the t-shirt body;

the middle pocket body being adjacently positioned in between the left pocket body and the right pocket body;

the upper opening comprising a left opening, a right opening, and a middle opening;

the upper opening traversing into the upper pocket body through the chest section;

the left opening traversing into the left pocket body through the chest section;

the right opening traversing into the right pocket body through the chest section;

the middle opening traversing into the middle pocket body through the chest section the lower pocket body being internally integrated to a waist section of the front panel;

the lower opening traversing into the lower pocket body through the waist section;

the left fastener being adjacently connected to the chest section, about the left opening;

the left opening being selectively enclosed by the left fastener;

the left cover being terminally connected to the chest section; and the left fastener being enclosed by the left cover;

the right fastener being adjacently connected to the chest section, about the right opening;

the right opening being selectively enclosed by the right fastener;

the right cover being terminally connected to the chest section;

the right fastener being enclosed by the right cover;

the middle fastener being adjacently connected to the chest section, about the middle opening; and the middle opening being selectively enclosed by the middle fastener;

the middle cover being terminally connected to the chest section;

the middle fastener being enclosed by the middle cover;

the lower fastener being adjacently connected to the waist section, about the lower opening;

the lower opening being selectively enclosed by the lower fastener;

the lower cover being terminally connected to the waist section;

the lower fastener being enclosed by the lower cover.

2. The t-shirt apparel with integrated deep pockets as claimed in claim 1, wherein the upper pocket body is waterproof.

3. The t-shirt apparel with integrated deep pockets as claimed in claim 1, wherein the lower pocket body is waterproof.

* * * * *